US007921896B2

(12) United States Patent
Andersen

(10) Patent No.: US 7,921,896 B2
(45) Date of Patent: Apr. 12, 2011

(54) TAPE DISPENSER THAT DISPENSES OVERLAPPING TAPE AND PAPER STRUCTURES

(76) Inventor: Benny Krog Andersen, Ft. McMurrary (CA)

( * ) Notice: Subject to any disclaimer, the term of this patent is extended or adjusted under 35 U.S.C. 154(b) by 548 days.

(21) Appl. No.: 12/009,207

(22) Filed: Jan. 17, 2008

(65) Prior Publication Data

US 2009/0183837 A1 Jul. 23, 2009

(51) Int. Cl.
*B32B 37/22* (2006.01)

(52) U.S. Cl. ..... 156/577; 156/527; 156/579

(58) Field of Classification Search ..... 156/527, 156/574, 577, 579
See application file for complete search history.

(56) References Cited

U.S. PATENT DOCUMENTS

| | | | | |
|---|---|---|---|---|
| 3,935,758 | A | | 2/1976 | Polzin et al. |
| 3,950,214 | A | | 4/1976 | Pool et al. |
| 4,096,021 | A | | 6/1978 | Pool et al. |
| 4,379,019 | A | | 4/1983 | Pool |
| 4,588,469 | A | | 5/1986 | Hunter |
| 4,818,329 | A | | 4/1989 | Tutas et al. |
| 4,906,322 | A | * | 3/1990 | Hollier ..... 156/527 |
| 4,915,769 | A | | 4/1990 | Heil et al. |
| 4,981,537 | A | | 1/1991 | Heil et al. |
| 5,037,501 | A | | 8/1991 | Lawson |
| 5,667,626 | A | | 9/1997 | Cayford et al. |
| 5,683,542 | A | | 11/1997 | Poole |
| 5,775,624 | A | | 7/1998 | Huerta |
| 6,502,616 | B1 | | 1/2003 | Row |
| 7,028,736 | B1 | | 4/2006 | Miller |

* cited by examiner

*Primary Examiner* — Mark A Osele
(74) *Attorney, Agent, or Firm* — Benjamin Edlavitch

(57) ABSTRACT

A device that dispenses tape structures comprising multiple lengths of overlapping tape. Rolls of tape are attached to the device in a manner that allows the device to unroll lengths of tape into at least one guide and pressing mechanism. In the event that multiple lengths of tape pass through or against the guide and pressing mechanism the lengths of tape overlap and combine into a tape structure comprising multiple lengths of overlapping tape. In a preferred embodiment of the device, the dispensed tape structure comprises adhesive on its opposing surfaces. After creating the tape structure, a blade cuts the tape structure and allows the device to dispense a portion of the tape structure. In addition, the device combines a length of paper with the tape structure by overlapping the length of paper and the tape structure.

17 Claims, 4 Drawing Sheets

TAPE DISPENSER THAT DISPENSES OVERLAPPING TAPE AND PAPER STRUCTURES

BACKGROUND

In various industries it is desirable to mask an area of a structure to prevent application of paint to the area. In general masking tape masks such structures, which include walls, doors, and trimming. In addition, structures are often masked with a combination of tape and paper. In the case of combining tape and paper for masking, paper is adhered to a structure by taping the paper to the structure. Usually the tape overlaps the paper when masking the structure.

To increase the efficiency of masking, painters use devices that dispense tape or a combination of tape and paper. Of these devices, a number of them dispense tape of different widths. However, few devices effectively dispense tape structures of varying widths by overlapping multiple lengths of tape. Moreover, few devices, if any, effectively overlap and combine multiple lengths of tape with paper to produce a masking structure of varying widths.

Another application of tape dispensing devices is the use of sealing packages. A large number of tape dispensers have been designed and manufactured for the use of sealing packages. A common method for sealing a package includes applying multiple lengths or layers of tape over flaps of a package. Such a method not only joins and seals the flaps of a package; it also reinforces the durability of the package.

In addition to increasing layers of a tape structure, increasing the width of a tape structure increases the durability of a package. A common method for increasing the width of a tape structure is to overlap lengths of tape. Current devices may assist in manually overlapping tape; however, few devices dispense overlapping tape structures. Even fewer devices dispense tape structures or tape and paper structures having adhesive on opposing surfaces of the structures.

SUMMARY

Described in the current application is a device that holds multiple rolls of tape and dispenses the rolls of tape in a manner where the tape overlaps and combines into a tape structure comprising multiple lengths of overlapping tape or multiple lengths of overlapping tape and paper. In a preferred embodiment, the tape structures comprise adhesive on opposite surfaces of the tape structure.

Rolls of tape are attached to the device in a manner that allows the device to unroll lengths of tape into at least one guide and pressing mechanism. In the event that the lengths of tape pass through or against the guide and pressing mechanism, the lengths of tape overlap and combine into a tape structure. Preferred embodiments of the device dispense tape structures comprising adhesive on opposing surfaces of the tape structures. After the device produces the tape structure, a blade cuts the tape structure, which allows the device to dispense a portion of the tape structure.

The device also allows for unroll lengths of tape and paper to pass into at least one guide and pressing mechanism. In the event that lengths of tape and paper pass through or against the guide and pressing mechanism, the lengths of tape and paper overlap and combine into a tape and paper structure. In preferred embodiments, the dispensed tape and paper structure comprises at least one surface comprising adhesive. In other preferred embodiments of the device, the tape and paper structures dispensed comprise adhesive on opposing surfaces. After the device produces the tape and paper structure, a blade cuts the tape and paper structure, which allows the device to dispense a portion of the tape and paper structure.

BRIEF DESCRIPTION OF THE DRAWINGS

Below is a description of example embodiments of a tape dispensing device that allows combining and dispensing of overlapping lengths of tape or allows combining and dispensing of overlapping lengths of tape and paper, in conjunction with appended drawings, wherein like reference numerals refer to like elements in figures, and wherein:

Figure one (labeled "FIG. 1" in the drawings) is a drawing of a preferred embodiment of the tape dispensing device, showing a rear view of the embodiment and parts of the embodiment;

Figure 1:
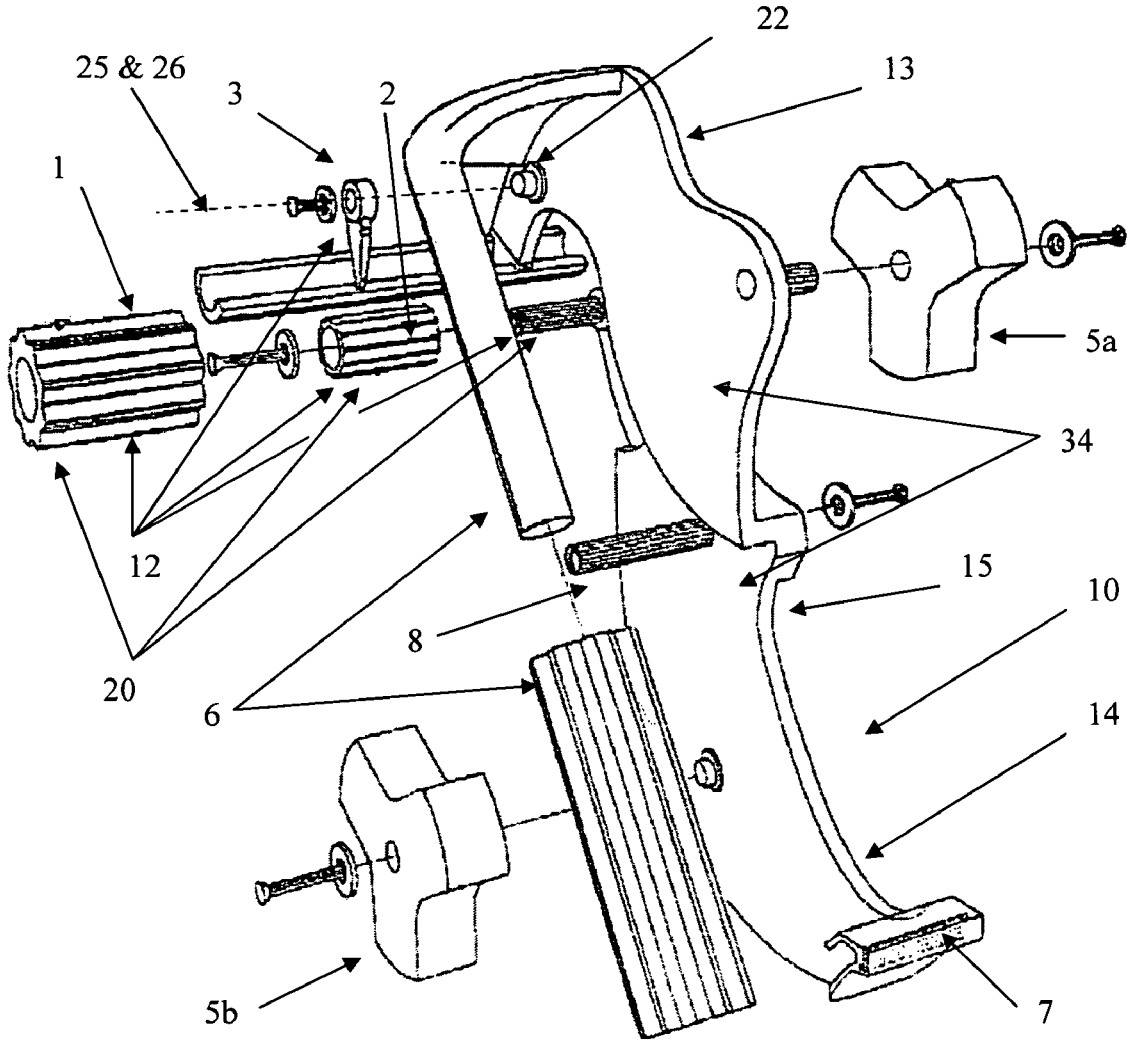
Figure 2:
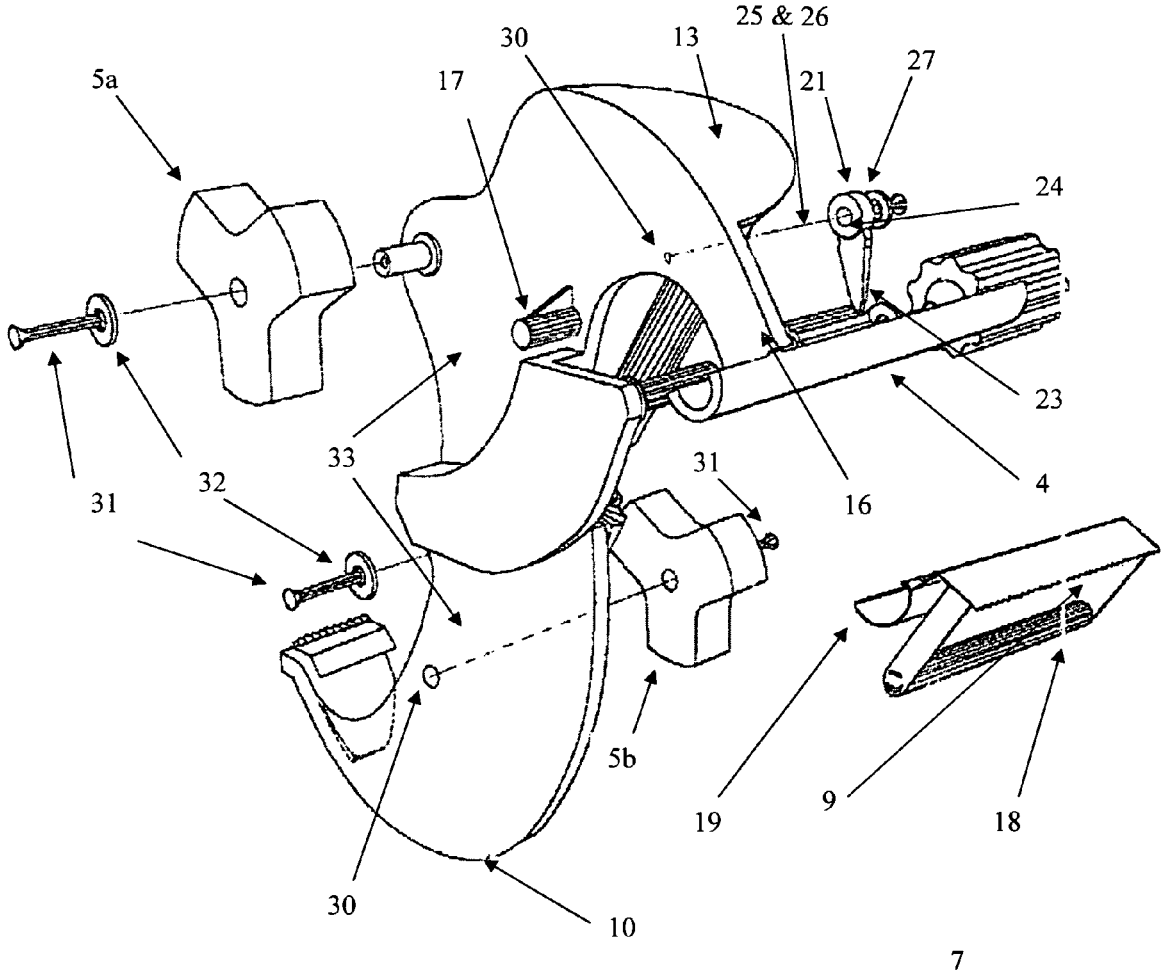
Figure 3:
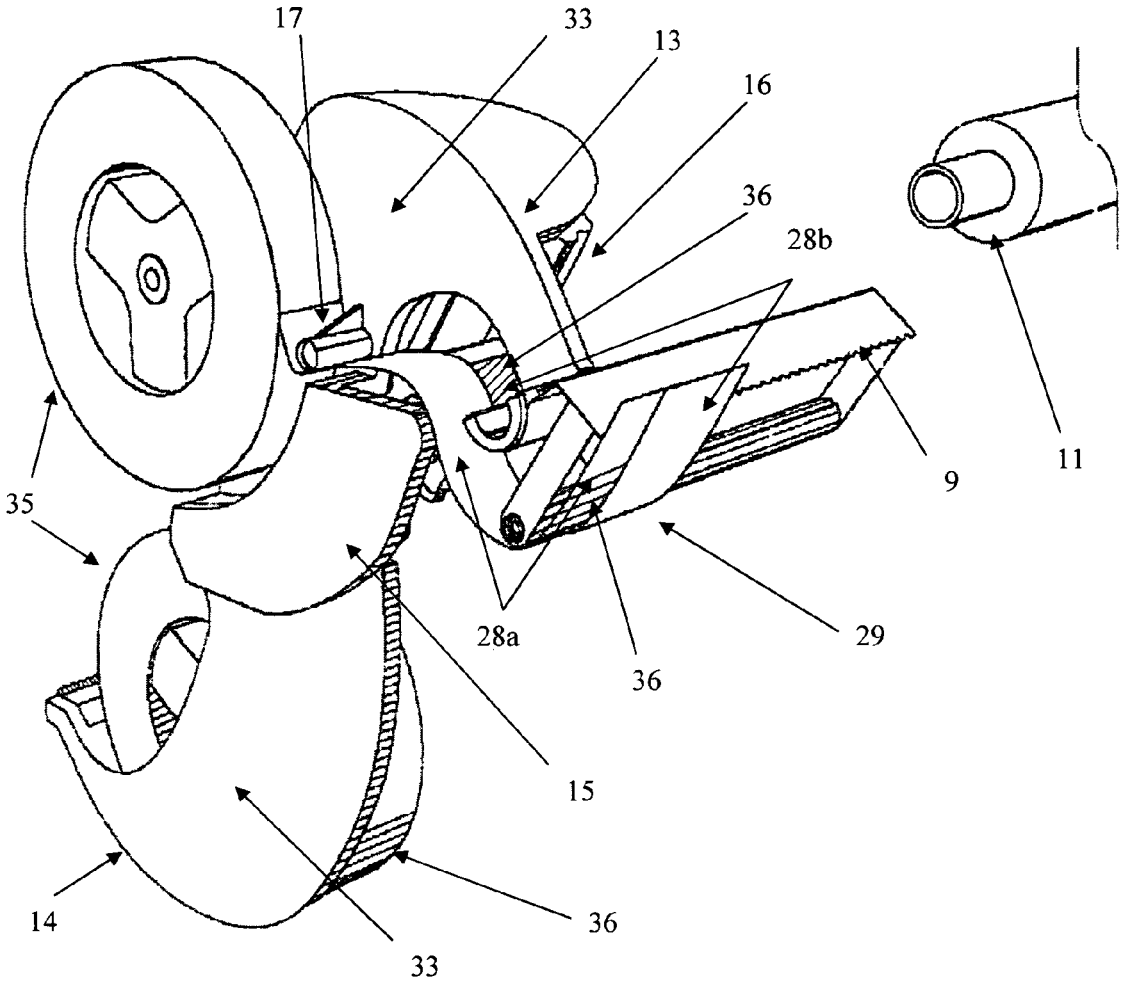
Figure 4:
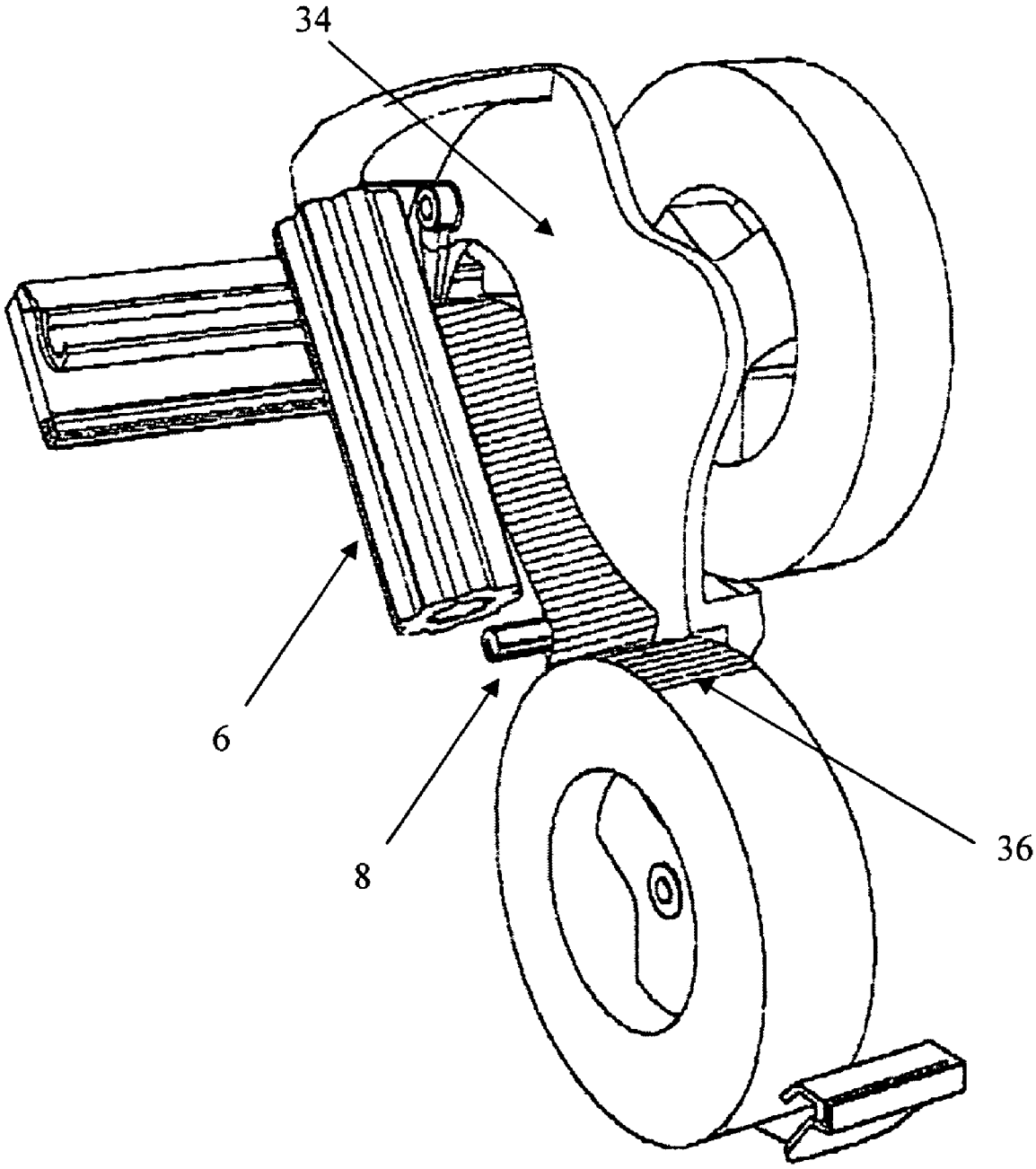

Figure two (labeled "FIG. 2" in the drawings) is a drawing of a preferred embodiment of the tape dispensing device, showing a front view of the embodiment and parts of the embodiment;

Figure three (labeled "FIG. 3" in the drawings) is a drawing of a preferred embodiment of the tape dispensing device, showing a front view of the embodiment; and Figure four (labeled "FIG. 4" in the drawings) is a drawing of a preferred embodiment of the tape dispensing device, showing a rear view of the embodiment.

DETAILED DESCRIPTION

Figures one through four depict preferred embodiments of a tape dispensing device that allows combining and dispensing of overlapping lengths of tape or allows merging and dispensing of overlapping lengths of tape and paper. In preferred embodiments of the device, the dispensed tape structure comprises adhesive on opposite surfaces of the tape structure (see figure three and four). In figures three and four, parallel lines crossing the tape structure denote adhesive on a tape surface 36.

In figures one through four, the embodiments of the device comprise a frame 10 (labeled in figures one and two); a blade 9 (labeled in figures two and three); two tape rollers 5*a* & 5*b* (labeled in figures one and two); and a guide and pressing mechanism 12 (four parts of the guide and pressing mechanism are labeled "12" in figure one), which comprises a final roller 1 (labeled in figure one), a paper roller 2 (labeled in figure one), and a pivoting part element 3 (labeled in figure one).

In addition, the preferred embodiments comprise a handle 6 (labeled in figure one and four). However, other embodiments may not comprise a distinct handle. For example, in other embodiments, areas of a frame may serve as a handle.

In figures three and four, Rolls of tape 35 (labeled in figure three) attach to the device in a manner that allows the device to unroll lengths of tape 28*a* & 28*b* (labeled in figure three) into the guide and pressing mechanism 12. In figures three and four, the top length of tape 28*a* comprises adhesive 36 on its bottom surface. The bottom length of tape 28*b* comprises adhesive 36 on its top surface. In the event that multiple lengths of tape 28*a* & 28*b* pass through the guide and pressing mechanism 12 the lengths of tape overlap and merge into a tape structure 29 (labeled in figure three). In the preferred embodiment, the tape structure 29 has adhesive 36 on opposing surfaces of the tape structure. After creating the tape structure 29, the blade 9 cuts the tape structure 29 and allows the device to dispense a piece of the tape structure 29.

In figure three, the embodiment of the device allows for unroll lengths of tape 28*a* & 28*b* and paper to pass into the guide and pressing mechanism 12. In the event that lengths of tape 28*a* & 28*b* and paper pass through or against the guide and pressing mechanism 12 the lengths of tape 28*a* & 28*b* and paper overlap and combine into a tape and paper structure. In the preferred embodiment, the tape and paper structure dispensed comprises adhesive on opposing surfaces. After creating the tape and paper structure, the blade 9 cuts the tape and paper structure and allows the device to dispense a portion of the tape and paper structure.

In the preferred embodiments, the paper roller 2 grips and holds unrolled lengths of paper from a paper roll 11 (labeled in figure three).

In other embodiments of the device there may be multiple paper rollers that grip and hold multiple lengths of paper. Moreover, other embodiments may produce tape structures comprising more than two lengths of tape. In addition, other embodiments may produce tape and paper structures comprising one length of tape and more than two lengths of tape; and more than one length of paper.

When a single length of tape is desired, figures one through four illustrate a second blade 7 (labeled in figure one) that can cut and dispense a single non-overlapping piece of tape. In a preferred embodiment and as shown in figures one through four, the second blade 7 has a serrated cutting edge.

In figures one through four, the frame 10 is s-shaped and comprises a top arm 13 that faces forward (labeled in figures one, two, and three), a bottom arm 14 that faces backward (labeled in figures one and three), and a middle area 15 in-between the top arm 13 and the bottom arm 14 (labeled in figures one and three). A top tape roller 5*a* attaches to the frame 10 on the top arm 13 on a first side 33 (labeled in figures two and three) of the frame 10. A blade 9 attaches to the frame 10 on a frontal end 16 (labeled in figures two and three) of the top arm 13, and the guide and pressing mechanism 12 attaches to the frame 10 approximately at the frontal end 16 of the top arm 13. A handle 6 (labeled in figures one and four) attaches to the frame 10 on the top arm 13 on a second side 34 (labeled in figures one and four) opposing the first side 33. A top guide 17 (labeled in figures two and three) attaches to the frame 10 on the top arm 13 on the first side 33. A bottom tape roller 5*b* attaches to the frame 10 on the bottom arm 14 on the second side 34. A bottom guide 8 (labeled in figures one and four) attaches to the frame 10 on the second side 34 on the middle area 15 in-between the top arm 13 and the bottom arm 14.

In addition, in the preferred embodiment a second blade 7 is attached to a back end of the bottom arm 14. As previously mentioned, the second blade 7 can cut and dispense a single non-overlapping piece of tape.

In figures one through four, the frame 10 further comprises multiple holes 30 (labeled in figure two). Multiple screws 31 (labeled in figure two) screw or insert into the holes 30. In addition, the screws 31 screw or insert into washers 32 (labeled in figure two) that lay in-between the heads of the screws 31 and the frame 10.

In another preferred embodiment, screws attaching rollers and guides to a frame of the device may have areas with a smooth surface, which allows the rollers and guides to rotate about the screws contacting the smooth surface of the screws.

In another preferred embodiment, nuts further secure parts attached to a frame by screws. Furthermore, it may be preferred to use wing nuts.

In preferred embodiments, screws of the device fit into holes throughout a frame, hollow cores of washers, hollow cores of guides, and hollow cores of rollers, which allow the guides and rollers to attach to the frame. In other embodiments, parts may attach to the frame by way of other attachment mechanisms.

In figures one through four, the blade 9 is serrated and is attached to a blade guide 18 (labeled in figure two) directly under the blade 9. The blade 9 has an extension 19 (labeled in figure two) that attaches the blade 9 to the frame 10 by a cutter holder 4 (labeled in figure two). In other embodiments, a blade attached to the device may have a straight cutting edge.

In figures one through four, the tape rollers 5*a* & 5*b* insert into the hollow core of a roll of tape. The tape rollers 5*a* & 5*b* secure rolls of tape in a manner that allows the rolls of tape to rollup and unroll.

In figures one through four, the guide and pressing mechanism 12 comprises a guide mechanism 20 (three parts of the guide mechanism are labeled "20" in figure one) and the pivoting part 3. The guide mechanism 20, as in figures one through four may comprise multiple rollers (see 1 & 2 of figure one). The pivoting part 3 comprises a pivoting end 21 (labeled in figure two), a pivoting-part bar element 22 (labeled in figure one), and a pressing end 23 (labeled in figure two).

In figures one through four, the pivoting-part bar element 22 comprises a horizontal axis 25 (labeled in figures one and two). The pivoting end 21 comprises an aperture 24 (labeled in figure two) with a horizontal axis 26 (labeled in figures one and two). The pivoting-part bar element 22 fits inside the aperture 24, wherein the horizontal axes 25 & 26 of the pivoting-part bar element 22 and the aperture 24 are collinear. The pivoting part 3 rotates on the horizontal axes 25 & 26 of the pivoting-part bar element 22 and the aperture 24.

The pressing end 23 of the pivoting part 3 is on an end of the pivoting part 3 opposing the pivoting end 21. In general, the pressing end 23 presses against the guide mechanism 20. A tension spring 27 (labeled in figure two) keeps pressure in-between the pressing end 23 and the guide mechanism 20.

In figures one and two, the guide mechanism 20 comprises the final roller 1 and the paper roller 2. In other preferred embodiments the guide mechanism may comprise a variation of smooth or ridged paper guides, smooth or ridged tape guides, paper rollers, tape rollers, and any combination thereof.

The guide and pressing mechanism 12 allows for at least two lengths of unrolled tape 28*a* & 28*b* (labeled in figure three) to pass in-between the pressing end 23 and the guide mechanism 20. The pressure in-between the guide mechanism 20 and the pressing end 23 guides unrolled lengths of tape 28*a* & 28*b* and allows for the lengths of tape 28*a* & 28*b* to combine into the tape structure 29 (labeled in figure three).

In addition to the guide mechanism 20 of the guide and pressing mechanism 12, preferred embodiments of the device may comprise additional guide mechanisms. The additional guide mechanisms may comprise smooth or ridged paper guides, smooth or ridged tape guides, paper rollers, tape rollers, and any combination thereof. For example, in figures one and two, the guides 8, 17, & 18 comprise a ridged outer surface; and in figures three and four, the guides 8 & 17 comprise a smooth outer surface.

The invention claimed is:

1. A tape dispensing device comprising in combination:

a frame;

a blade;

at least two tape rollers, wherein each said tape roller inserts into a hollow core of a roll of tape;

at least one guide and pressing mechanism that guides unrolled lengths of tape and allows said unrolled lengths of tape to overlap and combine into a tape structure;

said guide and pressing mechanism comprises a guide mechanism and a pivoting part;

said pivoting part comprises a pivoting end, a pivoting-part bar element, and a pressing end;

said pivoting-part bar element comprises a horizontal axis;

said pivoting end comprises an aperture with a horizontal axis;

said pivoting-part bar element fits inside said aperture where said horizontal axes of said pivoting-part bar element and said aperture are collinear, said pivoting part rotates on said horizontal axes of said pivoting-part bar element and said aperture;

said pressing end is on an end of said pivoting part opposing said pivoting end;

said pressing end presses against said guide mechanism;

a tension spring keeps pressure in-between said pressing end and said guide mechanism;

said guide and pressing mechanism allows for said unrolled lengths of tape to pass in-between said pressing end and said guide mechanism; and said pressure in-between said guide mechanism and said pressing end guides said unrolled lengths of tape and allows said unrolled lengths of tape to overlap and combine into said tape structure.

2. Said tape dispensing device in claim 1, wherein said tape structure comprises:

a top surface;

a bottom surface;

adhesive on said top surface; and adhesive on said bottom surface.

3. Said tape dispensing device in claim 1, wherein said tape structure comprises:

a top surface;

a bottom surface;

adhesive on said top surface; and adhesive on said bottom surface.

4. Said tape dispensing device in claim 1, wherein said blade is a serrated blade.

5. Said tape dispensing device in claim 1, further comprising a handle.

6. Said tape dispensing device in claim 1, wherein said guide mechanism is selected from the group consisting of smooth and ridged paper guides, smooth and ridged tape guides, paper rollers, tape rollers, and any combination thereof.

7. Said tape dispensing device in claim 1, further comprising at least one additional guide mechanism in addition to said guide mechanism of said guide and pressing mechanism.

8. Said tape dispensing device in claim 7, wherein said additional guide mechanism is selected from the group consisting of smooth and ridged paper guides, smooth and ridged tape guides, paper rollers, tape rollers, and any combination thereof.

9. Said tape dispensing device in claim 8, further comprising:

multiple holes throughout said frame;

multiple screws;

multiple washers;

said screws fit into said holes throughout said frame;

said screws fit into hollow cores of said washers;

said screws fit into hollow cores of said guides; and said screws fit into hollow cores of said rollers.

10. Said tape dispensing device in claim 9, wherein lengths of said screws have an area with a smooth surface, which allows said rollers and said guides to rotate on said lengths of said screws contacting said area with a smooth surface.

11. Said tape dispensing device in claim 9, further comprising multiple nuts to secure said rollers and said guides to said frame.

12. Said tape dispensing device in claim 1, wherein each said tape roller fastens said roll of tape.

13. Said tape dispensing device in claim 1, wherein said frame is s-shaped and further comprises:

a top arm that faces forward;

a bottom arm that faces backward; and a middle area in-between said top arm and said bottom arm.

14. Said tape dispensing device in claim 13, wherein:

said tape rollers comprise a top tape roller that attaches to said frame on said top arm on a first side of said frame;

said blade attaches to said frame on a frontal end of said top arm;

said guide and pressing mechanism attaches to said frame approximately at said frontal end of said top arm;

a handle attaches to said frame on said top arm on a second side of said frame opposing said first side;

a top guide attaches to said frame on said top arm on said first side;

said tape rollers comprise a bottom tape roller that attaches to said frame on said bottom arm on said second side; and a bottom guide attaches to said frame on said second side on said middle area in-between said top arm and said bottom arm.

15. Said tape dispensing device in claim 1, further comprising in combination:

at least one paper roller;

said guide and pressing mechanism overlaps and combines said unrolled lengths of tape and at least one length of paper into a tape and paper structure; and said tape and paper structure comprises a top surface, a bottom surface, and at least one of said surfaces of said tape and paper structure comprises adhesive.

16. Said tape dispensing device in claim 15, further comprising a second blade.

17. Said tape dispensing device in claim 16, wherein said second blade is a serrated blade.

* * * * *